US005089799A

United States Patent [19]

Sorenson

[11] Patent Number: 5,089,799

[45] Date of Patent: Feb. 18, 1992

[54] THERMAL SWITCH/BREAKER

[76] Inventor: Richard W. Sorenson, 6540 SE. Harbor Cir., Stuart, Fla. 34996

[21] Appl. No.: 646,156

[22] Filed: Jan. 25, 1991

[51] Int. Cl.[5] ..... H01H 71/16

[52] U.S. Cl. ..... 337/68; 337/74; 337/79

[58] Field of Search ..... 337/68, 66, 77, 91, 337/74, 79

[56] References Cited

U.S. PATENT DOCUMENTS

| | | | |
|---|---|---|---|
| 1,708,222 | 4/1929 | Getchell | 337/62 |
| 3,311,725 | 3/1967 | Butler et al. | 337/343 |
| 4,833,439 | 5/1989 | Bowden et al. | 337/68 |
| 5,004,994 | 4/1991 | Korczynski et al. | 337/68 |

*Primary Examiner*—Harold Broome

*Attorney, Agent, or Firm*—McCormick, Paulding & Huber

[57] ABSTRACT

An electric rocker switch has a thermally responsive movable contact element that is mechanically closed against the fixed contact, but moves by bimetallic thermal action to open when an overcurrent condition exists. A trip flag also moves between the open contacts whenever the switch rocker is moved to OFF, and will remain in this position even if the rocker is held ON, if the bimetallic element has caused the flag to move between the contacts. Trip-free operation is thereby achieved. A spring acts on the trip flag to provide a positive snap action as the flag moves between the contacts. The same spring holds the rocker ON, and serves to hold the flag lightly against the movable contact in the switch ON condition.

11 Claims, 3 Drawing Sheets

THERMAL SWITCH/BREAKER

This invention relates generally to a thermal switch/-breaker having as one function electrical on/off switching capability, and also including a built in circuit overload protection function. More particularly, this invention relates to an electric switch of conventional rocker appearance having at least one contact provided on a temperature responsive bimetallic element. When the bimetallic element is subjected to electrical resistance heating the switch contacts open, the rocker returns to its OFF condition, and an insulating flag moves between the contacts. The contacts cannot be recycled even if the rocker is held in its ON condition thereby providing "trip free" operation.

BACKGROUND OF THE INVENTION

The general concept of providing a flag or insulating element between a fixed and moveable switch contact is well known in the art. For example, Butler, U.S. Pat. No. 3,311,715 illustrates a push button breaker/switch of this general type. A moveable contact is provided on a bimetallic element to open in response to an overload condition. The device also operates as a conventional switch in that the moveable contact can be cammed from a closed to an open contact position in response to physically pulling the push button out.

Getchell, U.S. Pat. No. 1,708,222 illustrates a thermally responsive bimetallic element carrying a contact which is engaged by an insulating flag when the switch is toggled to the off condition, and which flag is adapted to be automatically switched to the off condition in response to heating of the bimetallic element. A spring is provided for moving the insulating flag from the ON condition of the contacts to the OFF condition.

Finally, U.S. Pat. No. 4,833,439 illustrates a combination switch and circuit protection device incorporating a bimetallic element carrying a moveable contact wherein a flag is adapted to move between the contacts in the switch closed position and to be moved out of this position when the contacts are opened. In the structure shown in the U.S. Pat. No. 4,833,439 patent the device is not capable of "trip free" operation in that the moveable actuator can be held in its ON position with the result that the thermally responsive contact will be physically closed unless and until the bimetallic element is again reheated.

The general purpose of the present invention is to provide a combination switch and circuit breaker device that exhibits "trip free" operation, and which comprises fewer moving parts than these prior art patents. Although Butler, U.S. Pat. No. 3,311,725 like the device of the present invention provides for pivotable movement of the actuator the present disclosure provides a switch configuration that is more like a conventional rocker switch than is the push button circuit breaker type device of Getchell or the toggle device of Butler.

The thermal switch is also configured to receive an indicator light behind the rocker for a visual indication of the electrical condition of the device itself (i.e.: ON or OFF).

SUMMARY OF THE INVENTION

In accordance with the present invention an electrical switch/breaker is provided in a generally rectangular housing having an upwardly open cavity for receiving a pivotable actuator or rocker. A moveable contact is provided within the housing on a bimetallic temperature responsive spring element having a free end portion defining a movable contact. The inherent resiliency of the spring element normally holds the moveable contact against a fixed contact in the housing and the bimetallic element biases the movable contact away from the fixed contact by the inherent temperature responsive characteristics of the bimetallic spring element.

A trip flag is moveably supported in the housing so that one portion of the flag is adapted to rest against the moveable contact when the contacts are closed, and this one flag portion is adapted to move between the moveable and fixed contacts when the switch is open.

The trip flag has a cam lobe or tooth defined adjacent an opposite end portion and this trip flag tooth is engageable by a first cam surface on the pivoting rocker-/actuator to create compound movement of the trip flag from a rest position (where the flag rests against the moveable contact) to a cocked position wherein the flag is spaced from the moveable contact and the fixed contact. As the actuator is moved from its off toward its on position the trip flag moves to this cocked position prior to being forcibly moved between the contacts into an active position.

Biasing means urges the trip flag tooth into contact with the actuators first cam surface, and also urges the one flag portion thereof toward its active position between the fixed and moveable contacts. Thus, the biasing means provides a snap action of the trip flag from the above-mentioned cocked position to the active position.

The biasing means also holds the rocker/actuator in the ON position by the interaction between the cam surfaces on the rocker and cam lobe or tooth on the trip flag.

The actuator or rocker also includes a second cam surface, and coupling means is provided between the second cam surface and the bimetallic spring element for moving the moveable contact away from the fixed contact as the actuator/rocker is moved from ON to OFF.

DETAILED DESCRIPTION OF THE DRAWINGS

Figure 1:
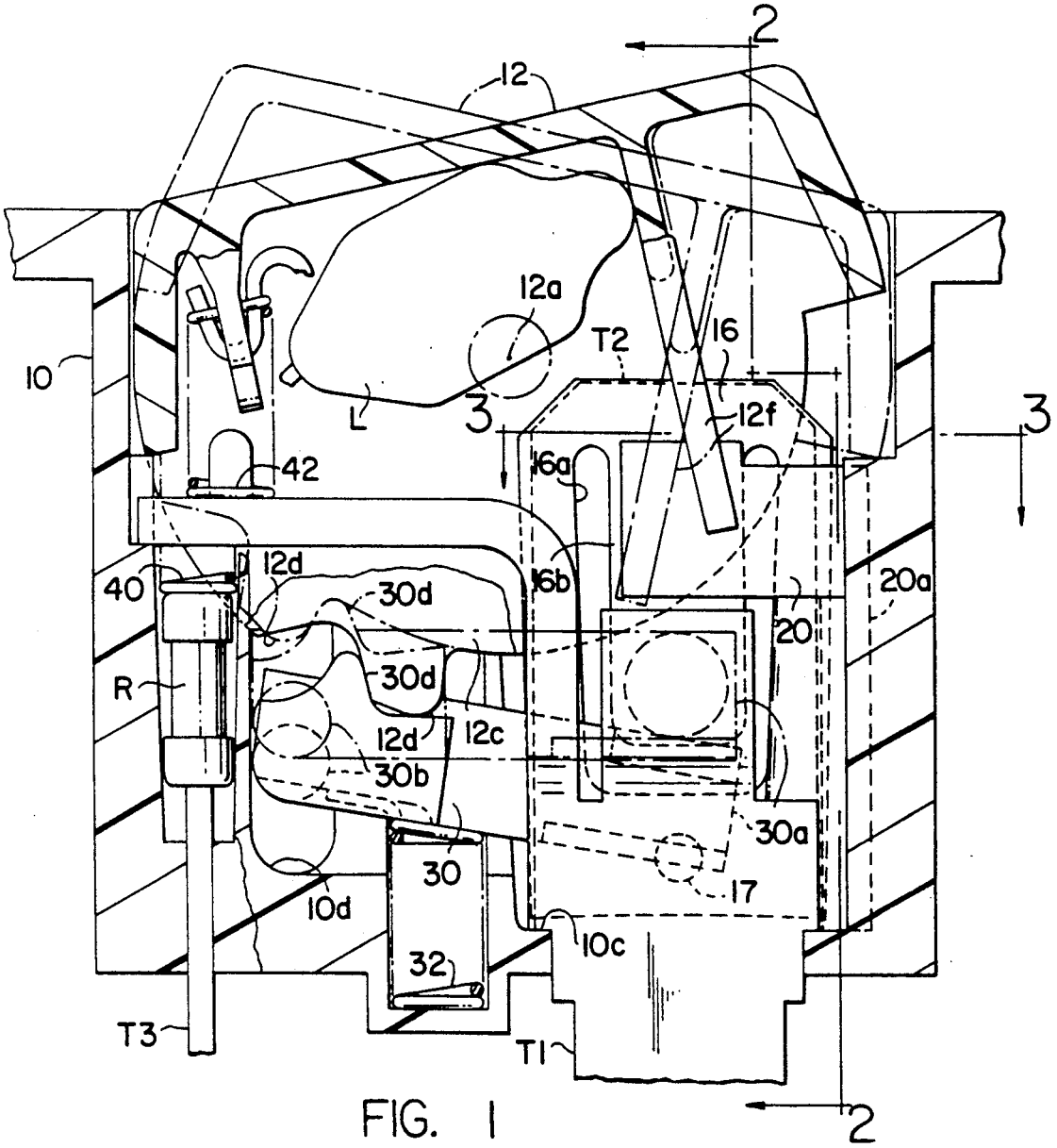
FIG. 1 is a vertical section taken through a switch/-breaker constructed in accordance with the present invention, and illustrates the rocker/actuator in position for closing the contacts. The phantom lines show the rocker/actuator in positioned for opening the contacts. A trip flag is driven by the rocker and is also shown in phantom lines in an active position between the moveable and fixed contacts. The solid line position shows the trip flag in its rest position.

Turning now to the drawings in greater detail, FIG. 1 shows a switch/breaker constructed in accordance with the present invention. The housing 10 is upwardly open and has a top flange so it can be conveniently mounted in a panel opening or the like. The housing 10 has a pivotable rocker 12 provided in the open top, and the rocker is hyphenated between the solid and phantom line positions shown on a pivot axis 12*a* defined in the switch housing. The rocker 12 may include laterally projecting axle portions (not shown) that are in turn received in openings provided for this purpose in the side walls of the housing.

Figure 2A:
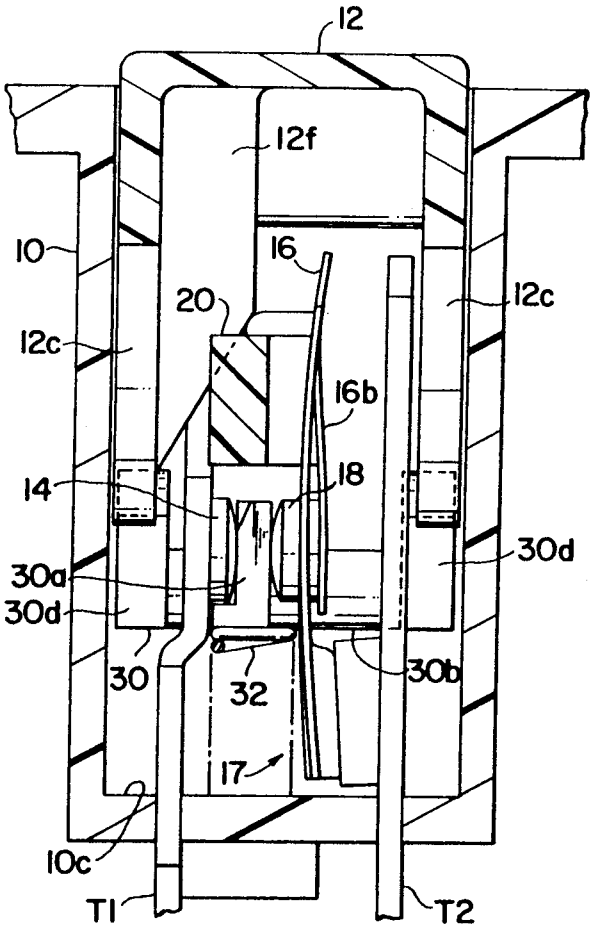
FIG. 2A is a sectional view of the switch/breaker showing the rocker in the off position with the trip flag in its active position between the movable and fixed contacts.
Figure 2:
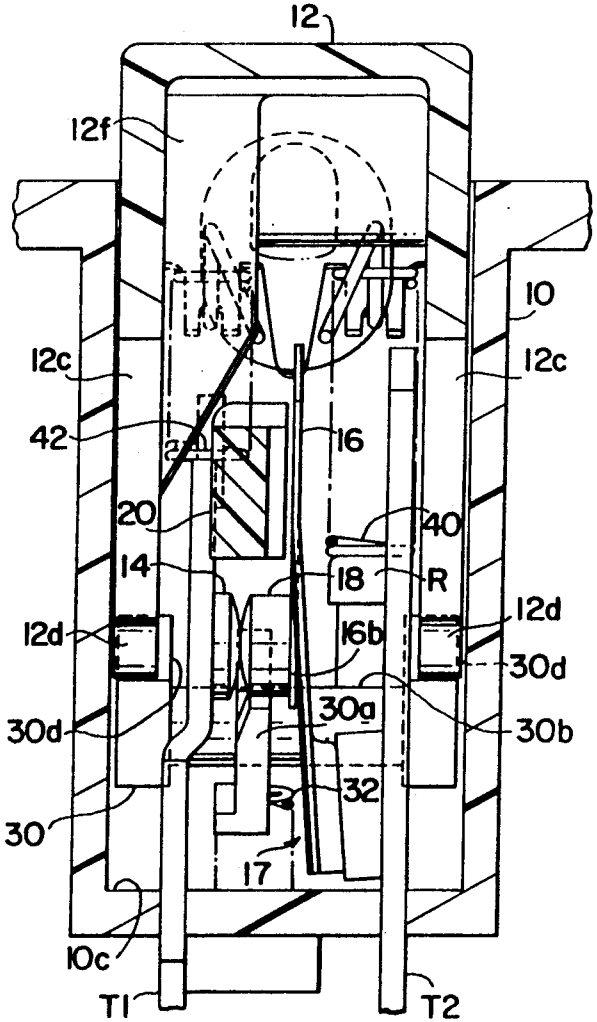
FIG. 2 is a vertical section taken generally on the line 2—2 of FIG. 1.

The switch housing 10 has a bottom wall 10*c* defining openings for at least two terminals T1 and T2 as best shown in FIG. 2. The terminal T1 is electrically connected to a fixed contact 14 inside the switch housing. The fixed contact 14 is preferably mounted on an extension of the terminal T1 as best shown in FIG. 2. The second terminal T2 also has a portion extending inside the switch housing cavity and is electrically connected, as for example by riveting or the like, to one end portion of a bimetallic temperature responsive element 16.

The bimetallic element 16 has a U-shaped slot 16*a* defined therein with the result that a tongue portion 16*b* is adapted to deform in response to a predetermined temperature rise of the bimetallic material from which it is made. This element 16, and its tongue portion 16*b*, move between the positions illustrated in FIG. 2 and FIG. 2A. A moveable contact element 18 is provided on the spring element arm 16*b*. The bimetallic element 16 with its associated moveable arm portion 16*b* is of conventional geometry. Element 16 is sometimes referred to as a "Taylor" blade and is available from Demich Industries, 70 Mill Street, Johnston, R.I. 02919.

As best shown by a comparison of FIGS. 2 and 2A the bimetallic element 16 is adapted to move from the normal contacts closed position of FIG. 2 toward the position illustrated in FIG. 2A as a result of thermal expansion of the bimetallic element 16 caused by an overcurrent condition in a circuit (not shown) defined between the load and line terminals T1 and T2 in these views. It will be apparent that the cantilever mounted bimetallic element 16 has its root end secured by a rivet or the like to the fixed terminal T2 as indicated generally at 17. The free end portion of the element 16 is adapted to move from the position shown in FIG. 2 to that shown in FIG. 2A. The depending spring element arm portion 16*b* will also move from the position shown for it in FIG. 2 to that illustrated in FIG. 2A and the result is to achieve opening movement of movable contact 18 relative to the fixed contact 14.

As mentioned above thermal expansion of the bimetallic element 16 corresponds to opening movement of the contact 18. In addition, mechanical opening movement of the contact 18 is also possible through movement of the rocker 12 from the contacts closed position shown in solid lines in FIG. 1 to the phantom line position illustrated in that view. The rocker 12 has a tapered cam surface 12*f* on an integrally formed leg. This cam moves from the position shown for it in FIG. 2 to the position shown in FIG. 2A during movement of the rocker 12 from the solid line position in FIG. 1 to the phantom line position in that view.

Figure 3:
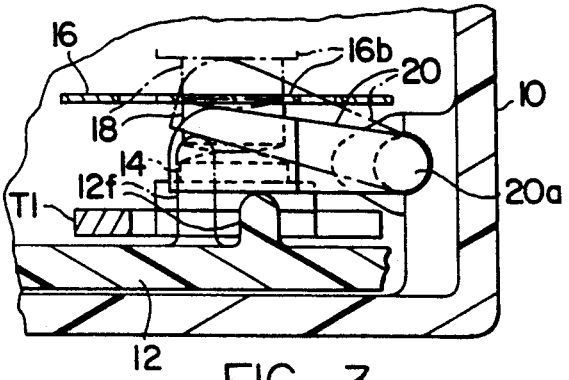
FIG. 3 is a generally horizontal section taken on the line 3—3 of FIG. 1, and illustrates a coupling wedge in two positions, that is in the phantom line position for opening the switch contacts and in the solid line position for closing the switch contacts.

FIG. 3 is a horizontal section taken generally on the line 3—3 of FIG. 1. As shown in FIGS. 2 and 2A the cam surface 12*f* on rocker 12 is adapted to move downwardly and to move the wedge 20 between the solid and phantom line positions illustrated in FIG. 3. The pivoted wedge or coupling element 20 has one end portion 20*a* pivotably received in a socket defined for this purpose in the end wall of the housing 10 as best shown in FIG. 3. Downward movement of the actuator cam surface 12*f* causes horizontal pivoting movement of the wedge or coupling means 20 from the solid to the phantom line position illustrated in FIG. 3. The cantilever mounted bimetallic element 16, and more particularly the depending arm portion 16*b*, is moved by the coupling element or wedge 20 from the solid line position illustrated in FIG. 3 to the phantom line position illustrated in this view. FIG. 2 and FIG. 2A show such movement of the coupling means 20 and of the bimetallic element arm 16*b*. It will be apparent that the abovementioned cam surface 12*f* on the actuator 12 causes mechanical opening of the contact 18 as a result of rocker movement between the solid line and the phantom line position illustrated in FIG. 1.

Still with reference to the rocker/actuator 12 the rocker has relatively deep depending side walls 12*c*, 12*c* as best shown in FIG. 2. Each of these depending side walls 12*c* define a depending cam lobe or tooth 12*d*. Each cam lobe or tooth 12*d* is adapted to engage a cam lobe or tooth on a moveable trip flag to be described. As best shown in FIG. 1 each depending cam lobe or tooth 12*d* on the rocker 12 moves between the limit positions shown in FIG. 1 in solid and phantom lines. That is, in the solid line position, the tooth 12*d* cooperates with one face or side of an upstanding cam lobe or tooth 30*d* on one end of the trip flag 30, and for reasons to be described defines a rest position for the trip flag 30 such that an opposite end portion 30*a* of the trip flag 30 rests against the moveable contact 18 as best shown in FIG. 2.

In the phantom line position shown for the rocker 12 in FIG. 1 the cam lobe or tooth 12*d* on the rocker cooperates with the opposite side or face of the upstanding cam lobe or tooth 30*d* of the trip flag 30 to define a position for the trip flag 30 such that the opposite or free end portion 30*a* has moved upwardly between the fixed and moveable contacts to the active position such as that illustrated in phantom lines in FIG. 1. FIG. 2A shows the flag 30 in its active position between the contact 14 and 18. In this active position the trip flag 30 provides an effective electrical insulation between these fixed and moveable contacts 14 and 18.

The trip flag 30 has two end portions 30*d* which cooperate with the two teeth 12*d* laterally spaced on the depending skirt portions 12*c* of the rocker 12. Still with reference to the trip flag 30 it will be apparent from FIG. 2 and FIG. 2A that the trip flag 30 defines at least one and preferably two axle portions 30*b*, which are in turn received in vertically elongated slots 10*d* as best shown in FIG. 1 and FIG. 1A.

Figure 1A:
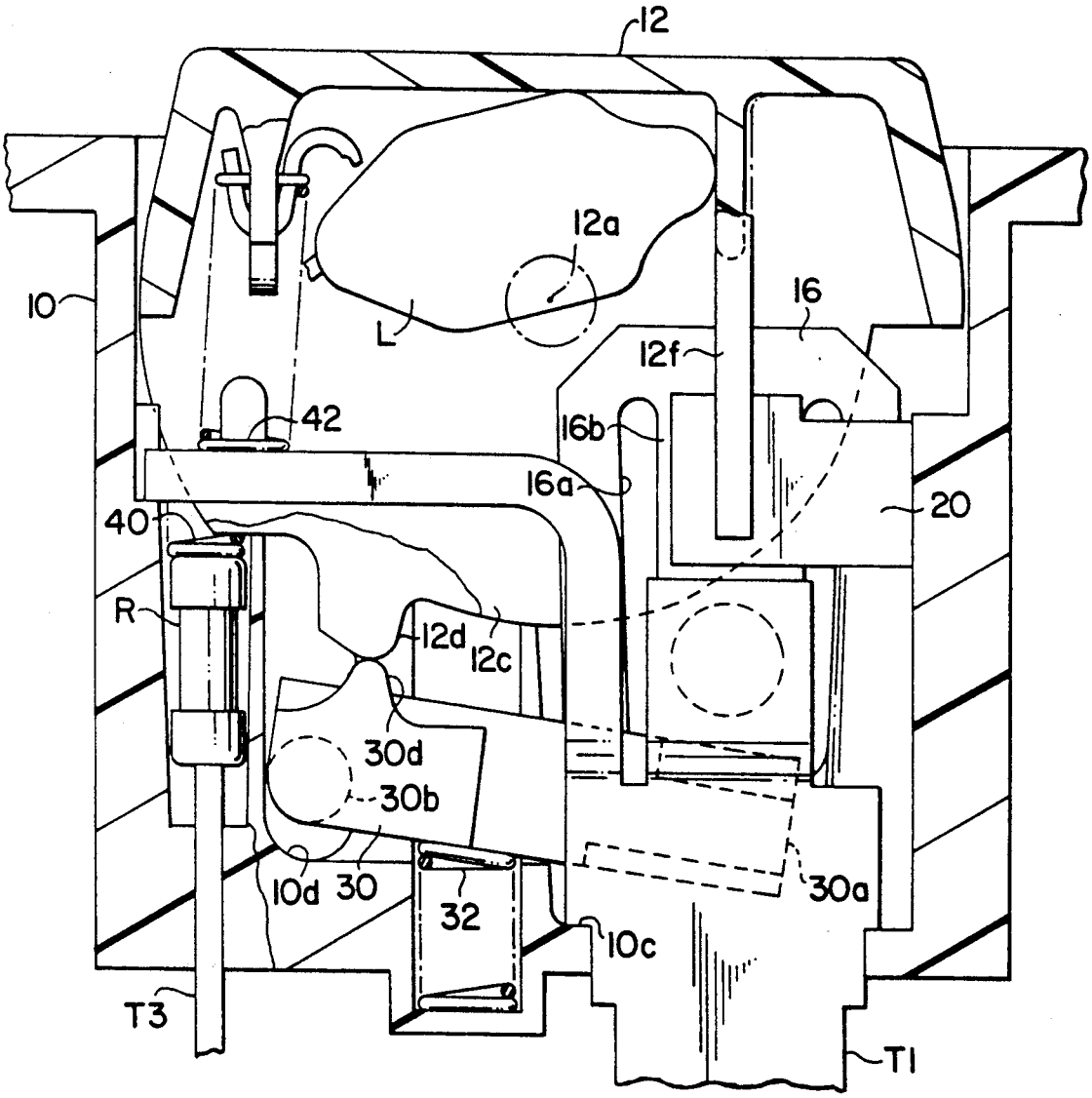
FIG. 1A illustrates the switch of FIG. 1 with the rocker/actuator in an intermediate position and also illustrates the trip flag in a cocked position.

FIG. 1A illustrates in solid line the position for the rocker 12 and the trip flag 30 when the trip flag 30 is in its cocked position, that is in a transitory (unstable) position during movement of the trip flag 30 from the solid to the phantom line position of FIG. 1. In this cocked position it will be apparent that the end portion 30*a* of the trip flag 30 has moved away from the contacts 14 and 18 so as to compress the return spring 32 and create a snap-action of the trip flag 30 during contact opening movement of the movable switch/breaker components.

The switch/breaker of the present invention is "trip free" in operation in that once element 16 has caused the rocker to move to its OFF position, manually moving the rocker back to ON will prevent the components of the device from resuming their ON positions until the element 16 has returned to its normal temperature.

The switch/breaker may have a lamp L provided inside the rocker 12, and more specifically between the rocker skirts 12*c*, 12*c*. In the illuminated version lamp leads electrically connect the lamp to at least one terminal T1, and to a third terminal T3. A resistor R is provided in a cavity defined for this purpose inside the housing, and a spring 40 serves to connect the lamp through the resistor to the terminal T3. A second spring 42 connects the lamp to the terminal T1. These springs 40 and 42 maintain this electrical connection in spite of movement of rocker 12, and also serve to bias the rocker toward its OFF position. Spring 42 would be provided even in a non-illuminated version to urge the rocker toward its OFF position.

The spring 32 urges the rocker toward it's ON position as a result of the geometry of the trip flag tooth 30*d* and that of the cam lobe tooth 12*d* of the rocker. The spring 32 acts through the flag to hold these teeth in engagement with one another. Thus, spring 32 serves several purposes, it provides a stable ON position for the rocker 12, it provides a snap action for the flag to move between the contacts when the contacts are open, and yet it exerts a light force on the movable contact itself when the contacts are closed and the rocker is ON. The trip flag abuts the movable contact only at the end 30*a*, so spring 32 exerts only a light force at that location, most of the force from the spring in the ON position (FIG. 1) being reacted by the interengaging teeth 12*d* and 30*d* as described previously.

I Claim

1. An electrical switch comprising;

a housing, an actuator supported in said housing for movement between ON and OFF positions, said actuator having a first cam surface, a fixed contact in said housing, movable contact means in said housing and including a bimetallic temperature responsive spring element with a fixed portion and a movable portion, a movable contact on said movable portion and normally held against said fixed contact by the inherent resiliency of said spring element, said movable portion being self biased away from said fixed contact by the inherent temperature responsive characteristics of said bimetallic spring element due to an overcurrent condition, a trip flag supported for generally pivotal movement in said housing between a rest position wherein a portion of said flag rests against said movable contact, and an active position wherein said flag portion lies between said movable and said fixed contacts, means for providing limited movement of a pivot defining portion of said flag, said trip flag having a cam lobe tooth defined adjacent said pivot defining portion thereof and said trip flag tooth engageable by said actuator first cam surface to cause movement of said trip flag from said rest position to a cocked position wherein said flag portion is spaced from said movable and fixed contacts as said actuator is moved from OFF toward ON, and, biasing means urging said trip flag tooth into contact with said actuator first cam surface and urging said flag portion toward said active position between said fixed and movable contacts.

2. The combination of claim 1 wherein said biasing means also acts through said tooth and said first cam surface to define a stable ON position for said actuator.

3. The combination of claim 1 wherein said means providing limited movement of said trip flag pivot portion comprises an axle portion thereof pivotably supported in a slot defined by said housing, said first cam surface on said pivotable actuator defining a tooth-like projection, said tooth-like projection having a front face and a rear face, and said trip flag tooth having opposed front and rear faces for engaging said actuator cam lobe to define said ON and OFF actuator positions, respectively, and said biasing means acting through said trip flag to define a stable ON actuator position.

4. The combination of claim 3 wherein said cocked position of said trip lever corresponds to the position of said actuator when its tooth-like projection has moved the trip flag tooth into a position wherein its pivot defining portion is most remote from said actuator first cam surface.

5. The combination of claim 4 wherein said actuator is a rocker, and said rocker has depending side skirts that define laterally spaced tooth-like projections, for engaging two cam lobe teeth defined at the ends of two trip flag axle portions, said housing defining two slots for slidably receiving said axle portions of said trip flag.

6. The combination of claim 5 further characterized by lamp means provided between said rocker skirts, said lamp means electrically connected to said fixed contact.

7. The combination of claim 6 wherein said lamp means includes two leads, and a spring electrically connecting one such lead to said fixed contact.

8. The combination of claim 7 wherein said fixed contact has a first terminal (T1) with a portion for engaging said spring, and wherein said movable contact means includes a second terminal (T2), said fixed portion of said bimetallic element secured to said second terminal, and a third terminal (T3) electrically connected to the other of said two lamp leads.

9. The combination of claim 8 further characterized by a second spring electrically connecting said other lamp lead to said third terminal, said lamp lead springs acting on said actuator to urge said actuator toward said OFF position.

10. The combination of claim 2 further characterized by second biasing means acting on said actuator to urge said actuator toward its OFF position.

11. The combination of claim 1 wherein said actuator has a second cam surface, and coupling means between said second cam surface and said resilient spring element for moving said movable contact away from said fixed contact as said actuator is moved from ON to OFF, said coupling means comprises a depending tapered leg defined by said actuator, and a pivoted wedge having one side engaged by said tapered leg and an opposite side for engaging said movable portion of said spring element, said spring element acting against said wedge to normally urge it toward said depending tapered leg on said actuator.

* * * * *